United States Patent [19]

Schulze et al.

[11] Patent Number: 4,748,840

[45] Date of Patent: Jun. 7, 1988

[54] FASTENING A HYDRAULIC DRIVE IN ROLL STANDS

[75] Inventors: Dieter Schulze, Ratingen; Karl-Heinz Margraf, Langenfeld; Kurt Rotert, Duesseldorf, all of Fed. Rep. of Germany

[73] Assignee: Mannesmann AG, Duesseldorf, Fed. Rep. of Germany

[21] Appl. No.: 897,929

[22] Filed: Aug. 19, 1986

[30] Foreign Application Priority Data

Aug. 20, 1985 [DE] Fed. Rep. of Germany ..... 3529720

[51] Int. Cl.[4] ..... B21B 31/32

[52] U.S. Cl. ..... 72/245

[58] Field of Search ..... 72/248, 245, 20, 237, 72/243

[56] References Cited

U.S. PATENT DOCUMENTS

| | | | |
|---|---|---|---|
| 3,427,839 | 2/1969 | Neumann | 72/245 X |
| 3,435,649 | 4/1969 | O'Brien | 72/245 X |
| 4,007,618 | 2/1977 | Ponter | 72/245 |

FOREIGN PATENT DOCUMENTS

| | | | |
|---|---|---|---|
| 0021995 | 1/1981 | European Pat. Off. | 72/245 |
| 1195259 | 6/1965 | Fed. Rep. of Germany | 72/245 |

*Primary Examiner*—Robert L. Spruill
*Assistant Examiner*—Steve Katz
*Attorney, Agent, or Firm*—Ralf H. Siegemund

[57] ABSTRACT

Existing roll housings are retro-fitted with a hydraulic drive by placing a sleeve with a collar in the bore that used to accommodate an adjusting spindle. The sleeve has a threaded extension on which is screwed a nut with a flange to which, in turn, the drive is releasably fastened. The sleeve is tension-biased in that the collar is urged against an internal shoulder. The piston rod traverses the sleeve and holds the mount for the upper roll.

2 Claims, 1 Drawing Sheet

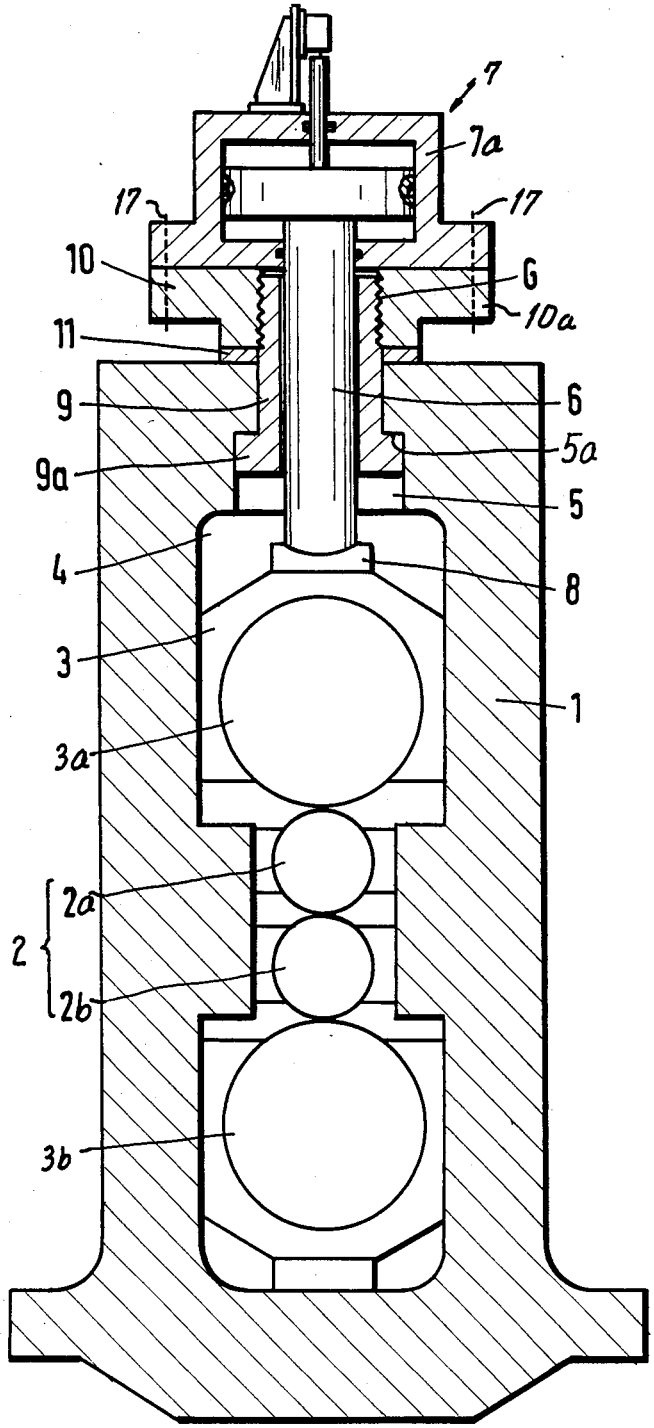
7
7a
17
17
10
G
10a
11
9
6
9a
5a
5
4
8
3
1
3a
2a
2
2b
3b

FASTENING A HYDRAULIC DRIVE IN ROLL STANDS

BACKGROUND OF THE INVENTION

The present invention relates to the fastening of a hydraulic control and positioning cylinder above the casing or housing in a stand and frame for a rolling mill, for the purposes of replacing a electromagnetic adjustment device by hydraulically operated one whereby the piston of the hydraulic drive is to penetrate that bore in the casing or housing that was used to accommodate an adjusting spindle, and wherein the free end of the piston rod acts on a mounting structure for roll, and wherein a structure is provided to take up the rolling force.

Generally speaking, it has become customary to modernize and refurnish older rolling mills and stand particularly because present day requirements concerning quality and concerning particular tolerances are no longer met by these older mills. In furtherance of this objective, the existing electromechanical roll adjustment devices and structures have been or are to be replaced by hydraulic adjusting devices. Alternatively, the existing electromagnetic roll adjustment is not replaced but supplemented in that one provides a tolerance improving supplemental hydraulic drive, basically constructed to have a short stroke. This hydraulic unit is arranged above or below the rolls, inside the so-called window of the rolling mill stand/housing. Of course, as already stated, one may use the hydraulic drive as a complete replacement for the electromechanical adjusting drive for the rolls. For this kind of retro-fitting particular constructions are known wherein the bore receiving the adjusting threaded sleeve which cooperates with the adjusting spindle, is closed through a cover, and the cylinder of the hydraulic drive is then placed inside of the housing window of the frame or stand. In other known construction the space is used that is now made available through the removal of the threaded adjusting sleeve and the hydraulic drive cylinder is inserted in that bore.

In some cases, the housing window is quite small so that the hydraulic drive can not be accommodated; in other cases the requisite the cylinder diameter of the hydraulic drive is larger than the now no longer used housing bore. In such a situation it is actually necessary to put these hydraulic drive above the frame. Here then, the piston rod will be run through the aforementioned bore and acts through a thrust bearing or the like on the rods. An example of this approach, for example disclosed in U.S. Pat. No. 4,007,618.

The latter construction is disadvantaged by the fact that the fastening of the cylinder of the hydraulic drive on the roll stand housing has to take up the maximum load that results from and during the rolling process. The state of the art proposes certain threaded connections and tension rods for purposes of fastening, but these modes of fastening the drive to the stand or housing are insufficient, at least the margin of safety is rather slim. Another disadvantage of the known approach is that the assembly as well as the disassembly in case of maintenance of the hydraulic drive is quite extensive and requires a large work area to accomplish that goal. Moreover, the aforementioned solution to the problem in accordance with the state art gives rise to the expectancy that owing to the expansion of frame parts that needed for fastening the hydraulic drive, on account of the rolling force, the quality of the rolled product deteriorates particularly because surface defects of various kinds appear on the rolled stock. Also, an exact measurement of the position of the rolls is no longer possible because the expansion of the aforementioned sleeve or other parts underload may introduce errors concerning the cylinder position in relation to the rolling stand and housing.

DESCRIPTION OF THE INVENTION

It is an object of the present invention to improve on the approach taken in accordance with the aforementioned U.S. Pat. No. 4,007,618 and to improve particularly the connection and fastening of a hydraulic drive for rolls such that surface defects and other negative and quality deteriorating influences will no longer be observed on retro-fitting a roll stand designed for electromechanical adjustment of rollers with a hydraulic adjustment drive.

It is another object of the present invention to provide for retro-fitting of roll stands such that loads acting on the roll mount are run into the roll stand and housing.

In accordance with the preferred embodiment of the present invention, the following combination of features is proposed. A sleeve is inserted into the bore through which was passed previously the spindle, or into any other suitable bore, e.g. in the top of the roll housing; the lower end of the sleeve carries a collar-like radial extension that bears against a shoulder in that bore; the sleeve projects with its threaded part from the upper end of of the housing and carries an annular nut with a mounting flange to which the cylinder of a hydraulic drive is releasably fastened; the sleeve is tension-biased in excess of the maximum tension that may result from the rolling force exerted thereon.

These features have the following purpose. The collarlike extension of the sleeve makes sure that loads resulting from rolling are reacted, as far as direction of action is concerned, into the housing right at that point where previously the spindle driving sleeve of a replaced electromagnetic drive had a similar or comparable function. Hence, as to this aspect the rolling stand housing does not have to be changed. By threading the annular nut upon the projecting threaded end of the sleeve it is made possible to fasten the adjustment drive directly to that annular part itself. This feature does not only facilitate mounting of the sleeve but also permits a high load to be exerted on the annular nut. The decisive feature is to be seen in that the propose construction makes possible the tensioning of the sleeve beyond any expansion that may result from maximum rolling load, to thereby eliminate any error in the indication of the cylinder position vis-a-vis the roll housing.

The fastening in accordance with the present invention permits the requisite pretension to be provided by the hydraulic drive itself; supplemental fine adjustment may be obtained by means of shims disposed between the housing and the nut and even under tension bias the drive can still be easily disassembled and removed, simply through release of the drive on the nut fastening. This feature does not only facilitate maintenance but shortens the time necessary for repair or any other exchage or replacement that may become necessary.

DESCRIPTION OF THE DRAWINGS

While the specification concludes with claims particularly pointing out and distinctly claiming the subject matter which is regarded as the invention, it is believed that the invention, the objects and features of the invention, and further objects, features, and advantages thereof will be better understood from the following description take in connection with the accompanying drawings in which:

The FIGURE illustrates a side view of an example for preferred embodiment of the present invention for practicing the best mode thereof.

Proceeding to the detailed description of the drawing, and specifically of the preferred embodiment of the invention, the figure shows a certain area of the rolling stand or frame, a section through the roll housing 1 being taken in the area of adjustment. The roll housing 1 accommodates rolls 2; there are upper and lower rolls 2*a* and 2*b*, upper roll 2*a* is journaled in roll mount 3*a* and lower roll 2*b* is journalled in roll mount 3*b*. The mount 3*a* is slideably movable in up and down direction within the housing window for of the stand housing 1. Any displacement of roll mount 3*b* is of no present concern.

Reference numeral 5 refers to a rather wide bore in housing 1 which, in conventional stands, accommodates the spindle drive nut which is provided for an electromechanical adjustment device using an adjusting spindle, as is conventional, particularly in older adjusting practice. If provided, it would bear against a step or shoulder 5*a* in the bore 5, the step results of a narrowing of the bore 5 in upward direction.

In accordance with the invention and for purposes of retro-fitting, the bore 5 receives a tubular sleeve 9 having a collar like radial extension 9*a* which abuts the step or shoulder 5*a*. The upper end of the sleeve 9 extends beyond the roll housing 1 and is provided with a threading G. An annular nut 10 with wide flange 10*a* is threaded onto that threading G.

The mounting flange part 10*a* of the nut 10 has a cylinder 7*a* of an hydraulic drive 7 bolted thereto. Lines 17 denote schematically the bolt connection. Reference numeral 6 refers to the piston rod extending from the piston 7*b* of the hydraulic drive 7. This piston rod 6 is coaxially arranged and penetrates coaxially accordingly the sleeve 9, as well as the bore 5. The lower end of piston rod 6 acts on and is connected to a pressure bearing piece 8 being part of the upper roll mount 3*a*. This way adjusting force by the hydraulic drive 7 is exerted upon the roller mount 3*a* and the roll 2*a* journalled therein.

In order to offset any expanding of the sleeve 9 as possibly resulting from the rolling force, the sleeve 9 is tension biased in that a force is exerted by the hydraulic drive 7 upon the sleeve 9 by having the piston push cylinder 7 up. The force is made larger than the largest force that can be expected to be exerted upon the sleeve 9 on account of the rolling. This tension bias causes, in fact, an extension and expansion of the sleeve 9 such that the ring 10 is actually lifted off the roll housing 1. Now, an adjusting shim, disk, annulus or the like, (11) is interposed into the gap that forms between the housing 1 and the nut 10 on the account of the aforementioned tension bias, this end maintains the bias of and on the sleeve 9, even after the hydraulic action is releaved.

It can thus be seen that the invention provides for a very effective and constructionally simple connection of a hydraulic drive to a housing in a roll stand of a rolling mill. The mounting of this hydraulic drive is by in itself very simple and can be used in new constructions as well, but the primary purpose of the invention was to find a way to retro-fit older stands and housings in rolling mills, without any significant structural change, so that a hydraulic drive can be used as a replacement for the previously used electromechanical drive, using the available facilities, features, and aspects as much as possible.

The invention is not limited to the embodiments described above but all changes and modifications thereof not constituting departures from the spirit and scope of the invention are intended to be included.

We claim:

1. A structure for fastening a hydraulic drive to a rolling mill stand housing for the rolls of the stand, there being a bore in the housing comprising in combination:

the bore having a shoulder portion oriented in down direction;

a sleeve with a collar on one end being received by said bore such that the collar abuts said shoulder, said sleeve, when so positioned, projecting beyond the housing and having a threaded end, at least where projecting from said housing;

an annular nut being threaded onto the threaded portion of said sleeve and having a mounting flange;

means for releasably fastening said hydraulic drive to said mounting flange; and means for pretensioning and biasing said sleeve as to expansion, to exceed a maximum tension that may result from rolling.

2. The combination as in claim 1 there being shim means interposed between the housing and the nut to serve as said means for providing the biasing pretensioning.

* * * * *